US006023594A

United States Patent [19]

Okiyama et al.

[11] Patent Number: 6,023,594

[45] Date of Patent: Feb. 8, 2000

[54] IMAGE FORMING APPARATUS HAVING A PLURALITY OF IMAGE FORMING STATIONS INCLUDING DEVICES AND RECEIVING SECTIONS FOR DETACHABLY RECEIVING THE DEVICES

[75] Inventors: Yoshitatsu Okiyama; Makoto Yabuki; Junichi Ito, all of Tokyo, Japan

[73] Assignee: Oki Data Corporation, Tokyo, Japan

[21] Appl. No.: 09/104,710

[22] Filed: Jun. 25, 1998

[30] Foreign Application Priority Data

Jul. 4, 1997 [JP] Japan ..... 9-180094

[51] Int. Cl.[7] ..... G03G 15/01; G03G 15/00

[52] U.S. Cl. ..... 399/12; 399/112

[58] Field of Search ..... 399/12, 107, 110, 399/111, 112, 119, 120, 223, 298, 299; 347/115, 117, 138, 152

[56] References Cited

U.S. PATENT DOCUMENTS

| | | | |
|---|---|---|---|
| 4,740,808 | 4/1988 | Kasamura et al. | 399/12 |
| 4,803,521 | 2/1989 | Honda | 399/12 |
| 4,963,939 | 10/1990 | Kurando et al. | 399/12 |
| 5,014,094 | 5/1991 | Amitani et al. | 399/12 |
| 5,049,930 | 9/1991 | Okano et al. | 399/12 |
| 5,530,531 | 6/1996 | Girard | 399/120 |
| 5,745,825 | 4/1998 | Okawa et al. | 399/112 X |
| 5,848,329 | 12/1998 | Aoyama et al. | 399/111 X |

FOREIGN PATENT DOCUMENTS

| | | |
|---|---|---|
| 59-126562 | 7/1984 | Japan . |
| 4-338989 | 11/1992 | Japan . |
| 6-027814 | 2/1994 | Japan . |
| 9-166952 | 6/1997 | Japan . |

*Primary Examiner*—William Royer
*Assistant Examiner*—Sophia S. Chen
*Attorney, Agent, or Firm*—Akin, Gump, Strauss, Hauer & Feld , L.L.P.

[57] ABSTRACT

An image forming apparatus such as color electrophotographic printer has a plurality of image forming stations. Each image forming station includes an image forming cartridge and a toner cartridge mounted therein. The toner cartridge has a corresponding first engagement portion. The image forming cartridge has a receiving section with a corresponding second engagement portion. The receiving section detachably receives the corresponding toner cartridge therein with the second engagement portion fittingly engaging the first engagement portion. The first and second engagement portions are of a construction that they can be polarized such that the first engagement portions engage the second engagement portions in different engagement relations when the devices are received in the receiving sections, each of the toner cartridges being received in a corresponding one of the receiving sections. Such an engagement construction may also be applicable to the image forming cartridge and the receiving section formed in the body of the printer which receives the image forming cartridge. The image forming cartridges and the receiving sections are polarized such that they are fittingly engaged with each other in different engagement relations.

10 Claims, 18 Drawing Sheets

IMAGE FORMING APPARATUS HAVING A PLURALITY OF IMAGE FORMING STATIONS INCLUDING DEVICES AND RECEIVING SECTIONS FOR DETACHABLY RECEIVING THE DEVICES

BACKGROUND OF THE INVENTION

1. Field of the Invention

The present invention relates to an image processing apparatus.

2. Description of Related Art

An electrophotographic printer is one of widely used image processing apparatuses and incorporates an image processing cartridge detachably mounted to the printer. The image processing cartridge includes a developer cartridge detachably mounted thereto. The image processing cartridge is a generally cylindrical container and holds toner therein. The toner is discharged through holes formed in the container which are adapted to open and close, and is supplied to the developing roller of the image processing cartridge. The developing roller then supplies the toner to the electrostatic latent image on the drum to develop the electrostatic latent image into a toner image.

The toner image is then transferred by the transfer roller to the print medium and subsequently fused on the print medium. The medium is then discharged out of the printer after fixing.

An electrophotographic printer designed to form color images incorporates image processing cartridges for the respective primary colors, and a developer cartridge for a specific color is detachably received in a cartridge-receiving section of the corresponding image processing cartridge. Deficiency of color printing systems involving separate developer cartridges for the constituent colors is in the inadvertent misplacement of the toner cartridges in the printer. Misplacement of the cartridges destroys printed color images.

Therefore, the developer cartridges are designed to be in different shape according to color, thereby preventing inadvertent misplacement of the developer cartridges.

Toners of the respective colors are not necessarily consumed at the same rate. It is quite often that a particular color is used more than any other colors. Colors used more than other colors depend on individual print data and therefore it is difficult to predict what color or colors should be manufactured more than other colors. Moreover, if the toner cartridges are different in shape according to colors, then it is difficult to determine how many unfilled cartridges should be manufactured for each color.

However, a conventional electrophotographic printer requires an image processing cartridge and a developer cartridge for each primary color. Manufacturing developer cartridges different in shape necessarily increases the number of kinds of cartridges and manufacturing costs.

In order to solve this drawback, electrophotographic printers has been proposed where the developer cartridge and the mounting construction therefor are of the same design and shape for all the toner colors, and one of ribs or the like formed at a specific area in the developer cartridge is cut off to selectively polarize the cartridge for a corresponding color. However, once the ribs are cut off, the individual cartridges become different shapes. If they are to be recycled, separately storing the developer cartridges according to shape is difficult and therefore adds cost to the recycled containers. This construction does not lend itself to recycling.

SUMMARY OF THE INVENTION

The present invention is to solve the aforementioned drawbacks of the conventional electrophotographic printers.

An object of the invention is to provide an image processing apparatus where image quality is not destroyed due to inadvertent misplacement of the developer cartridges, and the toner cartridges can be recycled and manufactured at low cost.

Another object of the invention is to provide an image processing apparatus where the toner cartridges and image processing cartridges for the respective colors are built only by assembling a limited number of standardized parts in different ways.

An image forming apparatus has a plurality of image forming stations. Each image forming station includes an image forming cartridge and a toner cartridge mounted therein. The toner cartridge has a corresponding first engagement portion. The image forming cartridge has a receiving section has a corresponding second engagement portion. The receiving section detachably receives the corresponding toner cartridge therein with the second engagement portion fittingly engaging the first engagement portion. The first and second engagement portions are of a construction that they can be polarized such that the first engagement portions engage the second engagement portions in different engagement relations when the devices are received in the receiving sections, each of the toner cartridges being received in a corresponding one of the receiving sections.

This engagement construction may also be applicable to the image forming cartridge and the receiving section formed in the body of the printer which receives the image forming cartridge. The image forming cartridges and the receiving sections are polarized such that they are fittingly engaged with each other in different engagement relations.

Further a cope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodiments of the invention will be described in detail with reference to the drawings.

First Embodiment

Figure 1:
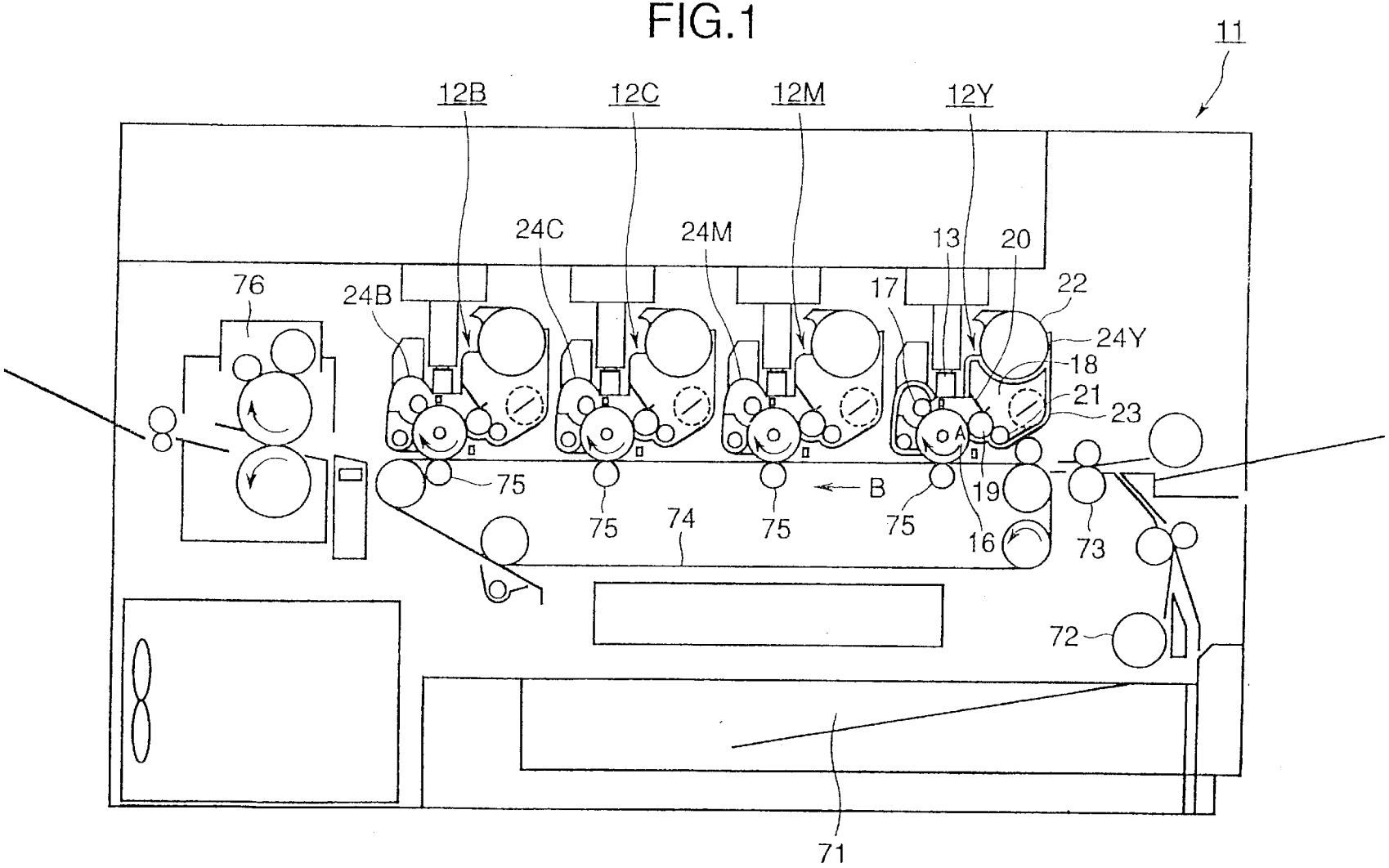
FIG. 1 illustrates a general construction of a color electrophotographic printer.

FIG. 1 illustrates a general construction of a color electrophotographic printer.

Referring to FIG. 1, an electrophotographic color printer 11 includes four printing stations for forming yellow, magenta, cyan, and black images, respectively, aligned in this order from a print medium insertion side to a print medium discharge side. Each of the printing station includes an image forming cartridge with a toner cartridge for a corresponding color. Mounted at the printing stations are image processing cartridges 12Y, 12M, 12C, and 12B, respectively.

The image forming cartridges 12Y, 12M, 12C, and 12B are of the same construction and therefore only the cartridge 12Y will be described and the description of the other cartridges is omitted.

The image forming cartridge 12Y includes an LED head, photoconductive drum 16, charging roller 17, developing roller 19, developing blade 20, sponge roller 21, and developer cartridge 22. The LED head 13 illuminates the photoconductive drum 16 in accordance with image data. The charging roller 17 uniformly charges the surface of the photoconductive drum 16. A toner container 18 holds toner of a corresponding color therein. The developing roller 19 develops an electrostatic latent image formed on the charged surface of the photoconductive drum 16 into a toner image. The developing roller 19 is in contact with a developing blade 20. The developing roller 19 also in contact with a sponge roller 21 and receives toner from the sponge roller 21. The developer cartridge 22 is detachably mounted to the cartridge 12Y via a mounting construction provided in the cartridge 12Y. A developing station is constituted of the toner container 18, developing roller 19, developing blade 20, sponge roller 21, and developer cartridge 22. The image forming cartridges 12Y, 12M, 12C, and 12B include a lower housing 23 and upper housings 24Y, 24M, 24C, and 24B, respectively.

Disposed at a lower part of the electrophotographic printer is a paper feeding mechanism 71. A print medium is fed by a feed roller 72 from a paper tray to a registry rollers 73. The registry roller 73 in turn feeds the print medium to a transport belt 74 which runs in a direction shown by arrow B. The print medium is attracted to the transport belt 74 and travels through the respective image forming cartridges 12Y, 12M, 12C, and 12B mounted to the respective stations, passing between the photoconductive drum 16 and the transfer roller 75 of the respective image forming cartridge so that images of corresponding colors are superposed one over the other on the print medium. After having passed through all of the image forming cartridges, the image printed on the medium becomes a full color toner image. The full color toner image is then fixed at the fixing station 76.

The operation of the electrophotographic printer 11 will now be described.

Upon activation of the printing operation, the print medium is advanced by the feed roller 72 from the paper tray. When the leading edge of the print medium has reached the registry rollers 73, the feed roller 72 is stopped by a clutch mechanism, not shown, while the print medium is being transported further by the registry rollers 73.

When the leading edge of the print medium has reached the transport belt 74, the transport belt 74 attracts the print medium thereto and transports the print medium to the yellow image forming cartridge 12Y. At this time, the LED head 13 is energized at predetermined timings in accordance with the image data and illuminates the surface of the photoconductive drum 16 to form an electrostatic latent image on the surface. The photoconductive drum 16 is rotated in a direction shown by arrow A. When the electrostatic latent image reaches the developing roller 19, the developing roller 19 applies the toner to the photoconductive drum 16 to develop the electrostatic latent image into a toner image.

Subsequently, the toner image on the photoconductive drum 16 is transferred to the print medium by the transfer roller 75. In this manner, the yellow toner image is transferred to the print medium. Likewise, magenta, cyan, and black toner images are subsequently formed by the image forming cartridges 12M, 12C, and 12B, respectively, and transferred by the corresponding transfer rollers 75 to print one over the other on the print medium, thereby forming a full color toner image. The print medium is subsequently transported to the fixing station 76 where the toner image is fixed into a full color image, and the print medium is ejected out of the fixing station 76.

The developer cartridge 22 will now be described.

Figure 2:
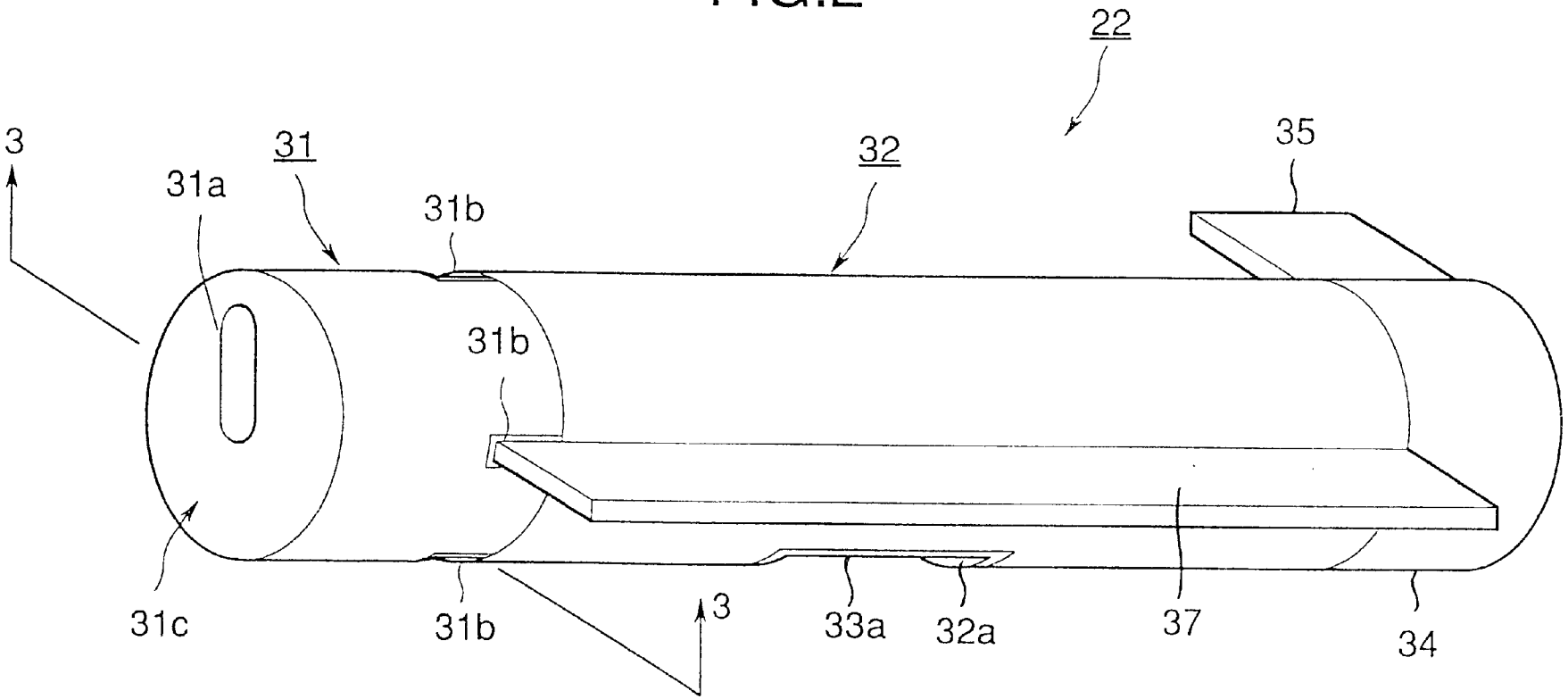
FIG. 2 is a perspective view of a developer cartridge according to a first embodiment of the invention.
Figure 3:
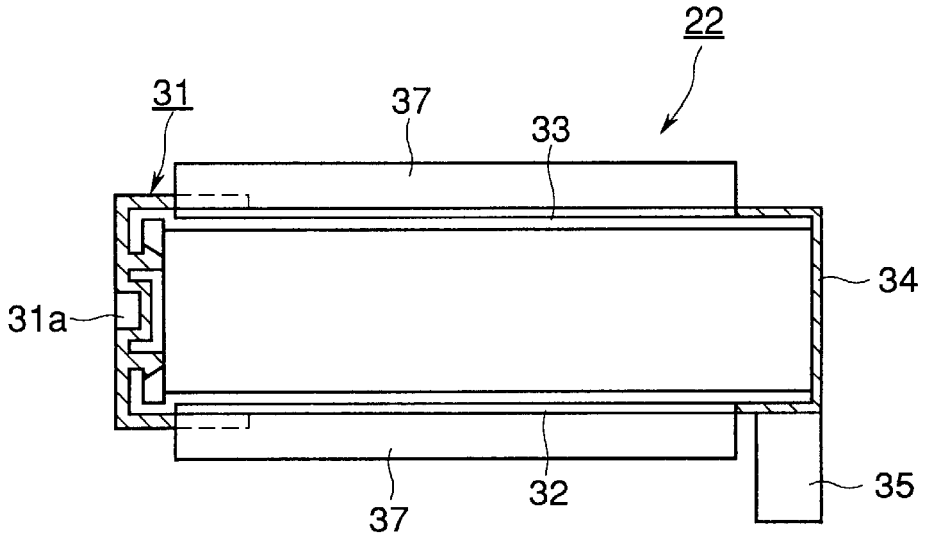
FIG. 3 is a cross-sectional view of the developer cartridge taken along lines 3—3 of FIG. 2.

FIG. 2 is a perspective view of a developer cartridge according to the first embodiment of the invention. FIG. 3 is a cross-sectional view of the developer cartridge taken along lines 3—3 of FIG. 2.

As shown in FIGS. 1 and 2, a cylindrical inner case 33 opens at both longitudinal ends thereof and is closed by a cap 34 at one end and closed by another cap 31 formed of a white, semitransparent, or transparent material. The cap 31 slidably fits over the inner case. The cap 34 has a lever 35 formed in one piece construction with the cap 34. A cylindrical outer case 32 rotatably holds the inner case 33 therein. Rotation stoppers 37 project from the outer case diametrically at two circumferential locations. The cap 31 is formed with four cutouts 31*b* into which the stoppers 37 are fitted so that the cap 31 is placed in position relative to the outer case 32. The cutouts are located relative to the central axis of the cylindrical cap 31 to diametrically oppose each other.

The outer case 32 and inner case 33 are formed with an opening 32*a* and an opening 33*a* therein, respectively, and the toner in the inner case 33 can be discharged when the inner case has been rotated till the openings 32*a* and 33*a* are aligned with each other. Once the developer cartridge 22 has been mounted to the cartridge-receiving section in a corresponding image forming cartridge, for example, 12Y, the cap 34 and inner case 33 can be rotated together relative to the outer case 32 when the lever 35 is rotated. When the lever 35 has been rotated to a position where the openings 32*a* and 33*a* are aligned each other, the toner in the inner case 33 is cascaded into the toner container 18 through the openings 32*a* and 33*a*. The developer cartridge 22 is mounted to the cartridge-receiving section such that the rotation stoppers 37 lie in a horizontal plane with the openings 32*a* facing down.

The cap 31 is formed with a groove-like recess 31*a* in its circular end surface 31*c*. The recess 31*a* radially extends substantially from the center of the circular surface 31*c*.

FIGS. 4, 5, 6, and 7 are side views of the yellow, magenta, cyan, and black developer cartridges according to the first embodiment.

Figure 4:
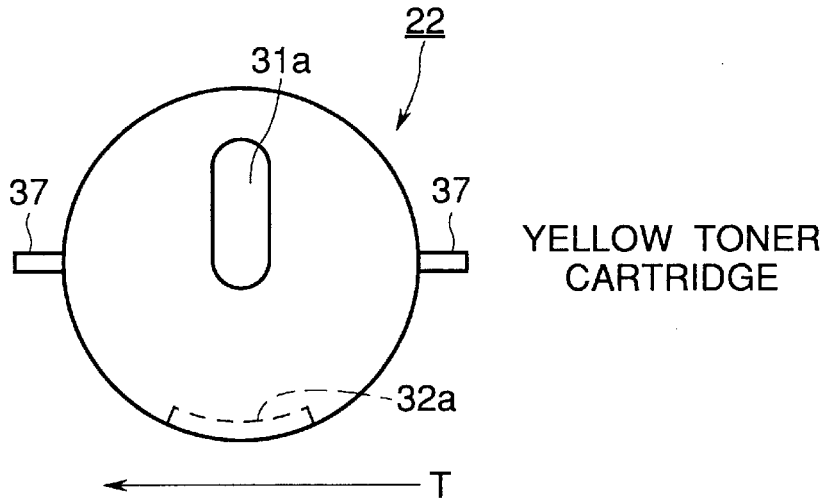
FIGS. 4, 5, 6, and 7 are side views of the yellow, magenta, cyan, and black developer cartridges according to the first embodiment.

Referring to FIGS. 4–7, the toner container 18 (FIG. 1) is disposed at the lower parts of the figures. FIG. 4 shows the developer cartridge 22 for yellow toner. The cutouts 31*b* in the cap 31 are engaged with the rotation stoppers 37 of the outer case 32 such that when the developer cartridge 32 is positioned with the opening 22*a* facing down, the recess 31*a* extends upwardly from the center of the circular end surface of the developer cartridge 22.

Figure 5:
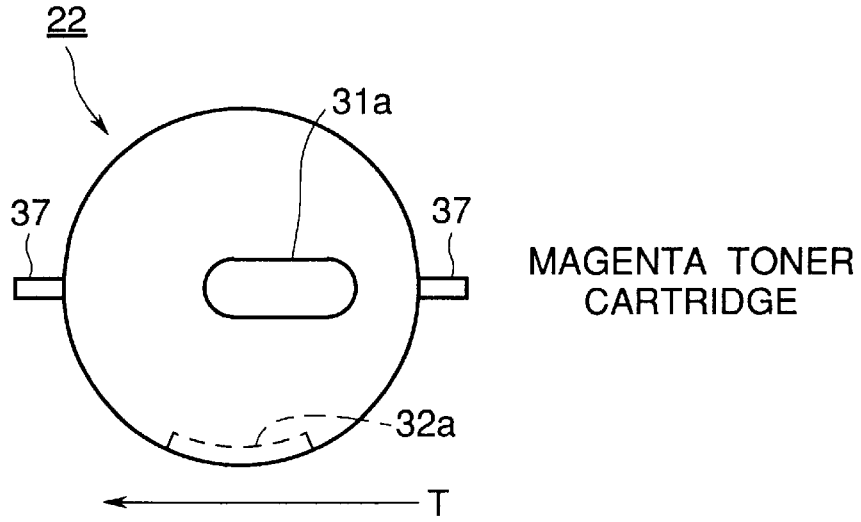

For the developer cartridge 22 for magenta toner, the cutouts 31*b* are engaged with the rotation stoppers 37 as shown in FIG. 5 such that when the developer cartridge 22 is positioned with the opening 32*a* facing down, the recess 31*a* extends in a direction of travel of the print medium shown by arrow T, upstream of the center of the circular end surface 31*c* of the developer cartridge 22.

Figure 6:
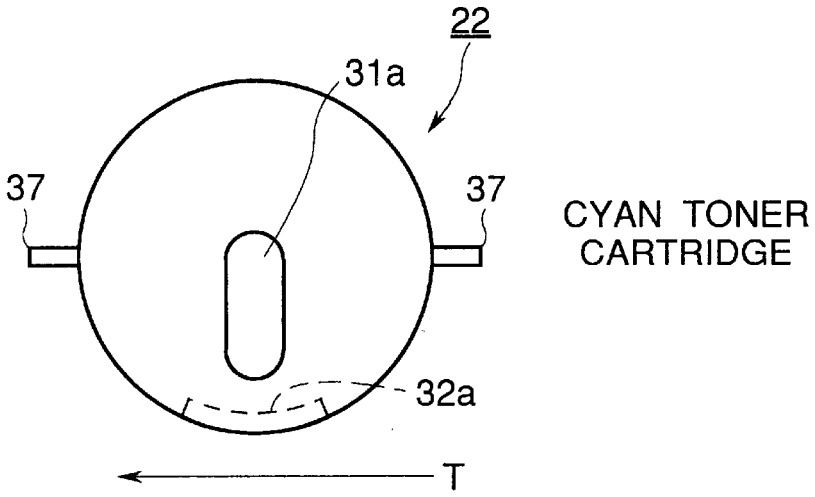

For the developer cartridge 22 for cyan toner, the cutouts 31*b* are engaged with the rotation stoppers 37 as shown in FIG. 6 such that when the developer cartridge 22 is positioned with the opening 32*a* facing down, the recess 31*a* extends downwardly.

Figure 7:
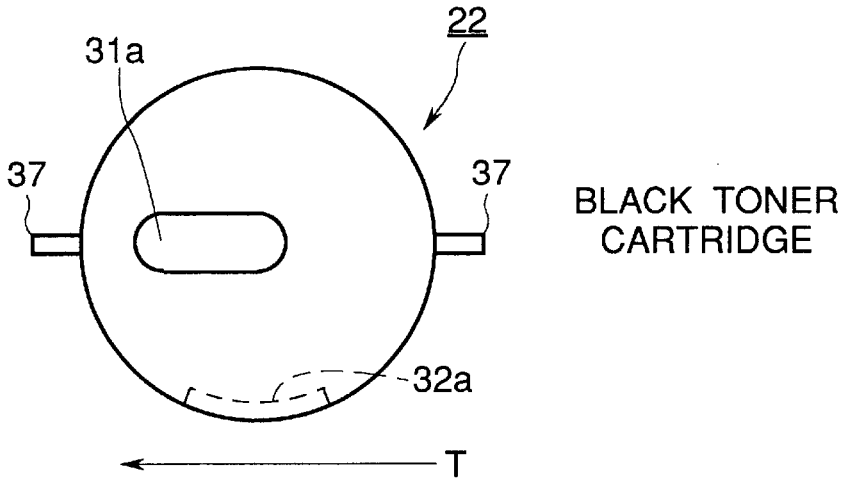

For the developer cartridge 22 for black toner, the cutouts 31*b* are engaged with the rotation stoppers 37 as shown in FIG. 7 such that when the developer cartridge 22 is positioned with the opening 32*a* facing down, the recess 31*a* extends in the direction of travel of the print medium shown by arrow T, downstream of the center of the circular end surface of the developer cartridge 22.

The cartridge-receiving sections in which the developer cartridges 22 are received will now be described. FIGS. 8, 9, 10, and 11 illustrate the cartridge-receiving sections of the image forming cartridges for yellow, magenta, cyan, and black, respectively, when seen in a direction shown by arrow R in FIG. 12.

The cartridge-receiving sections are generally long, semi-cylindrical in shape and includes a support 62, an engagement wall 63, and a wall 64. The engagement wall 63 and the wall 64 are oppositely formed at longitudinal ends of the cartridge-receiving section. The engagement wall 63 has a projection 24*b* that project inwardly of the cartridge-receiving sections. A semi-cylindrical support 62 receives and supports the developer cartridge 22 from under the developer cartridge. The engagement wall 63 and the wall 64 are of generally round plate-like shape. When the developer cartridge 22 is mounted in the cartridge-receiving section, the wall 64 opposes the cap 34, the engagement wall 63 opposes the cap 31 of the developer cartridge 22, and the projection 24*b* engages the recess 31*a* in the developer cartridge 22. Stopper-receiving edges 24*c* receive and support the rotation stoppers 37 of the developer cartridge 22 from under when the developer cartridge 22 is mounted into the receiving section.

A retainer 24*a* is formed on top of the engagement wall 63 and projects inwardly of the cartridge-receiving section. When the developer cartridge 22 is received in the receiving section, the retainer 24*a* engages the circumference of the cap 31 from above to prevent the developer cartridge 22 from rising.

Figure 8:
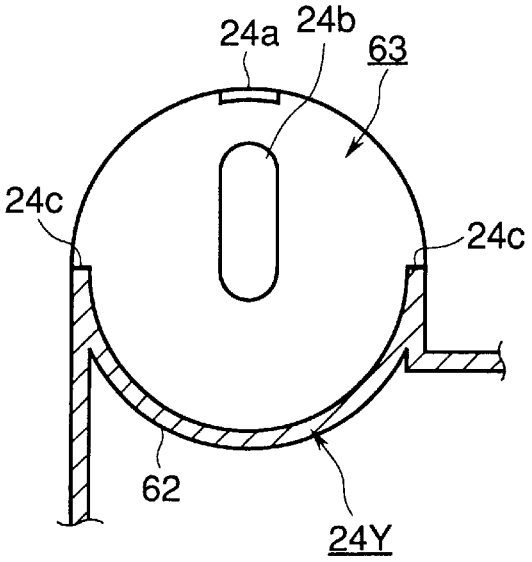
FIGS. 8, 9, 10, and 11 illustrate the cartridge-receiving sections of the image processing cartridges for yellow, magenta, cyan, and black, respectively.
Figure 9:
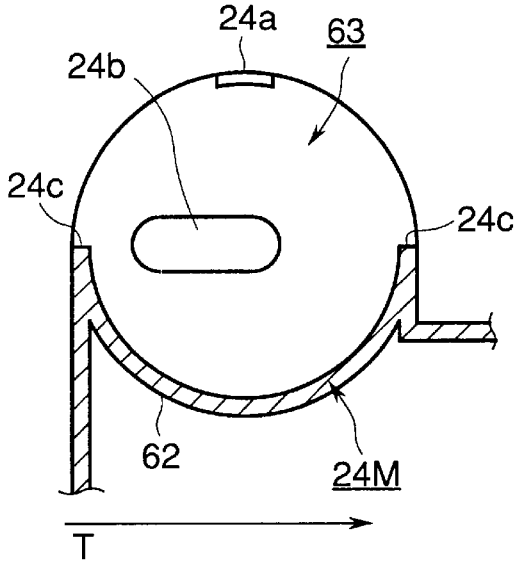
Figure 10:
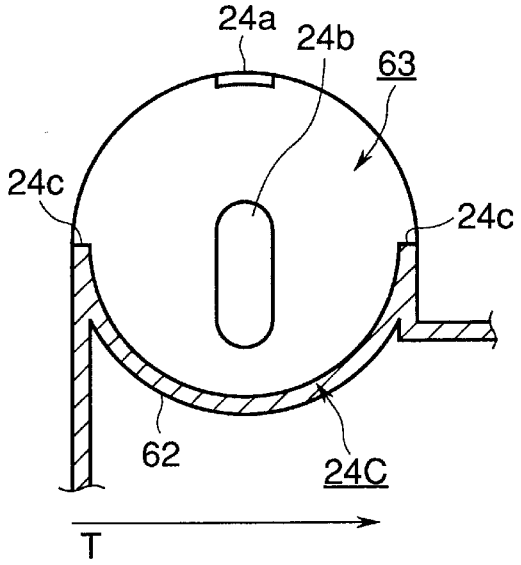
Figure 11:
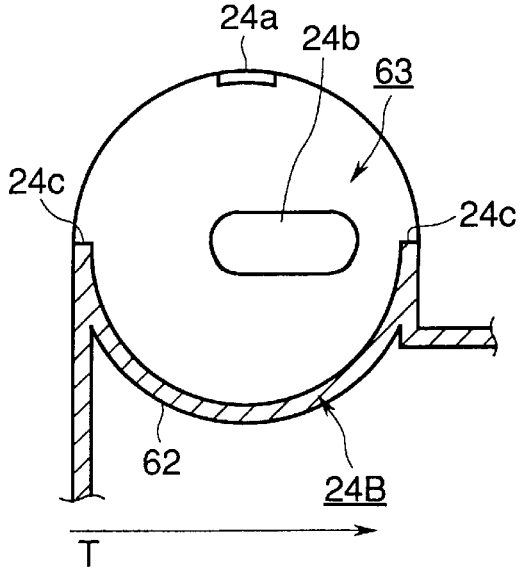

As shown in FIG. 8, the projection 24*b* for the yellow image forming cartridge 12Y projects into the cartridge-receiving section and extends upwardly from the center of the circular surface of the engagement wall 63. As shown in FIG. 9, the projection 24*b* for the magenta image forming cartridge 12M extends in the direction T of travel of the print medium, upstream of the center of the circular surface of the engagement wall 63. As shown in FIG. 10, the projection 24*b* for the cyan image processing cartridge 12C extends downwardly from the center of the circular surface of the engagement wall 63. As shown in FIG. 11, the projection 24*b* for the black image forming cartridge 12B extends in the direction T of travel of the print medium, downstream of the center of the circular surface of the engagement wall 63.

Figure 12:
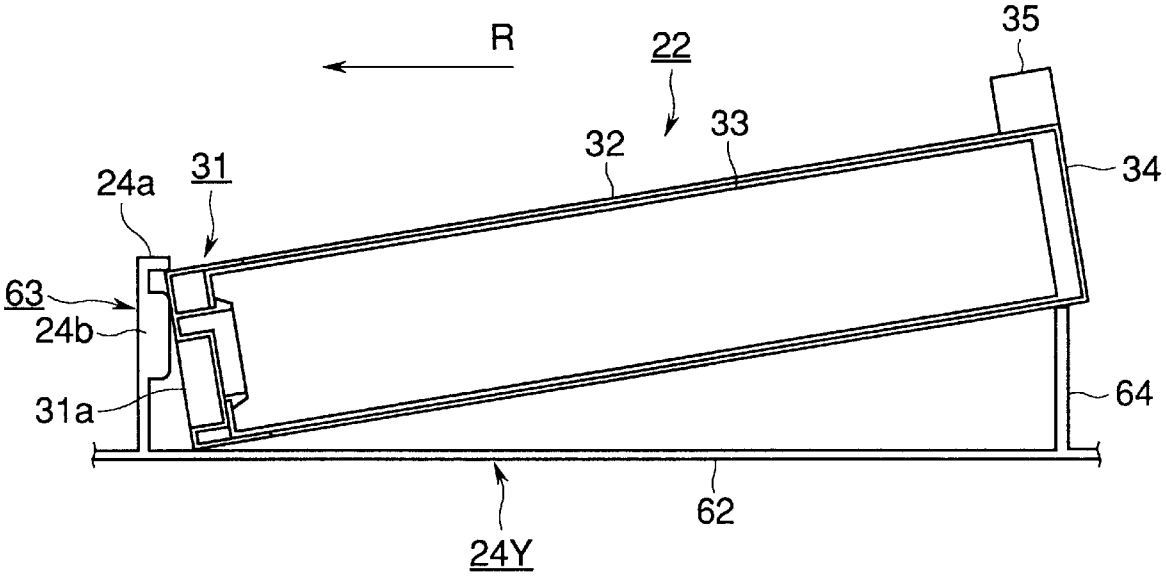
FIG. 12 illustrates the developer cartridge for cyan when a user attempts to mount it into the receiving section of the image processing cartridge for yellow.

FIG. 12 illustrates the developer cartridge 22 for cyan when a user attempts to mount it into the receiving section of the upper housing of the image forming cartridge 24Y for yellow.

The projection 24*b* of the receiving section extends upwardly from the center of the engagement wall 63 while the recess 31*a* of the cap 31 extends downwardly from the center of the cap 31. Therefore, the projection 24*b* cannot enter the recess 31*a*, preventing the developer cartridge 22 from being received into the receiving section.

Likewise, if the user attempts to mount the developer cartridge 22 for magenta or black into the cartridge-receiving section for the developer cartridge 22 for yellow toner, these developer cartridges 22 interfere with the projections 24*b* which are oriented in directions different from the direction in which the recess 31*a* of the developer cartridges extends.

Figure 13:
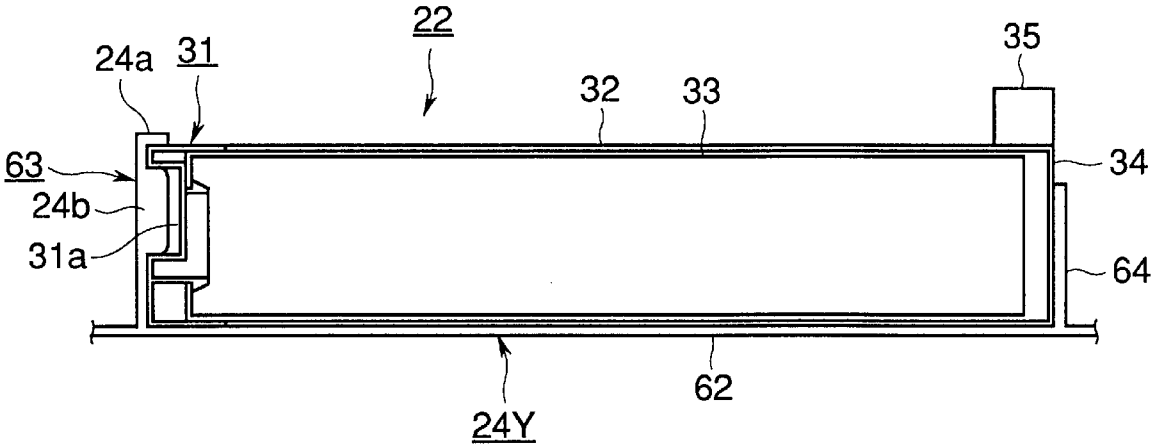
FIG. 13 illustrates the developer cartridge for yellow when it has been mounted into the receiving section of the yellow image processing.

FIG. 13 illustrates the developer cartridge 22 for yellow when it has been mounted into the receiving section of the upper housing of the yellow image forming cartridge 24Y. The projection 24*b* of the receiving section extends upwardly from the center of the engagement wall 63 and the recess 31*a* also extends upwardly from the center of the cap 31. Thus, when the developer cartridge 22 for yellow is introduced into the receiving section, the projection 24*b* is smoothly received into the recess 31*a,* thereby preventing inadvertent misplacement of the developer cartridge during the manufacture of the printer.

As mentioned above, the cap 31 is mounted to the outer case 32 at angularly different positions relative to the rotation stopper 37 of the developer cartridge 22 according to the color of the toner contained therein. This construction eliminates the need for manufacturing the developer cartridges 22 of different shapes depending on toner colors, and lends itself to the standardization of the cartridge construction and lowers the manufacturing cost of the printer 11.

Assembling the caps 31 to the outer cases 32 at different angular positions relative to the rotation stoppers 37 polarizes the developer cartridges such that the developer cartridges are accepted only by corresponding cartridge-receiving sections. Thus, developer cartridges for one color after use can be reassembled to make developer cartridges for another color by simply assembling the standardized parts in different ways. This makes recycling of the developer cartridge 22 easy and practical, facilitating the storage of the components as well as lowering the printer cost.

Only the developer cartridge 22 is formed with cutouts 31*b,* so that caps 31 can be arranged in different ways. However, the projection 24*b* can be made as a separate part and the engagement wall 63 may be formed with holes or the like so that the projection 24*b* can be detachably mounted to the holes, thereby allowing mounting of the projection 24*b* in different directions.

Second Embodiment

In the first embodiment, the projections 24*b* are oriented in different directions depending on the colors of toner contained in the developer cartridges. The orientations of the projections 24*b* are fixed, and therefore the cartridge-receiving section cannot be standardized. A second embodiment solves this drawback.

Figure 14:
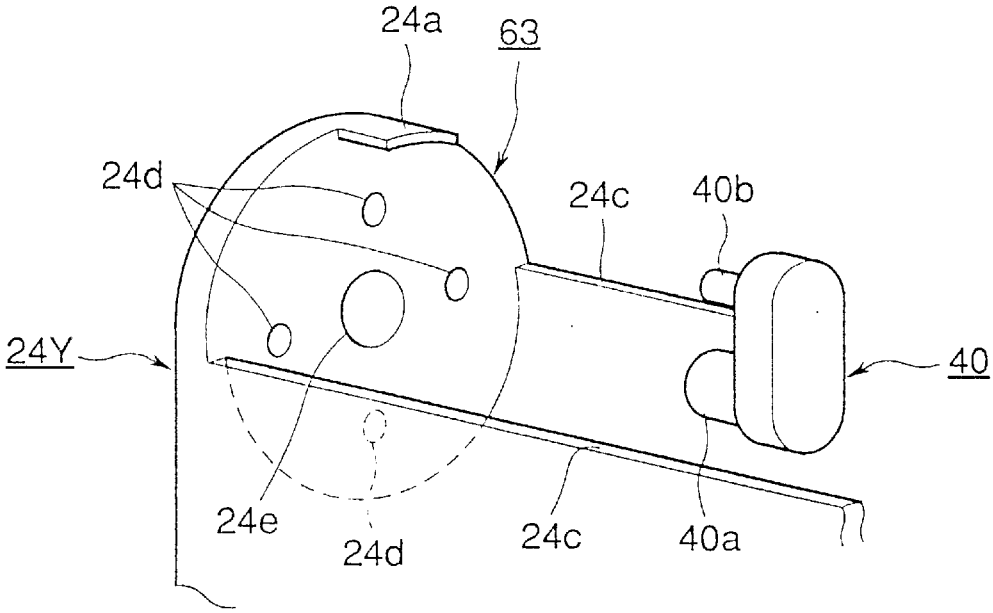
FIG. 14 is a perspective view of an image processing cartridge according to the second embodiment.

FIG. 14 is a perspective view of an image forming cartridge according to the second embodiment.

The image forming cartridges 12Y, 12M, 12C, and 12B are of the same construction and therefore only the image forming cartridge 121Y for yellow will be described.

The engagement wall 63 is formed with a large-diameter hole 24*e* in its center, two small-diameter holes 24*d* vertically diametrically opposing with respect to the large-diameter hole 24*e,* and two small-diameter holes 24*d* horizontally diametrically opposing with respect to the large-diameter hole 24*e.* An engagement piece 40 has a large-diameter projection 40*a* and a small-diameter projection 40*b* which project parallel to each other.

The large-diameter projection 40*a* fits into the large-diameter hole 24*e* and the small-diameter projection 40*b* fits into one of the four small-diameter holes 24*d* depending on which developer cartridge the receiving section receives thereinto. In this manner, the cartridge-receiving section can be polarized to accept only a developer cartridge of a corresponding color.

FIGS. 15, 16, 17, and 18 illustrate the image forming cartridges for yellow, magenta, cyan, and black, respectively.

Figure 15:
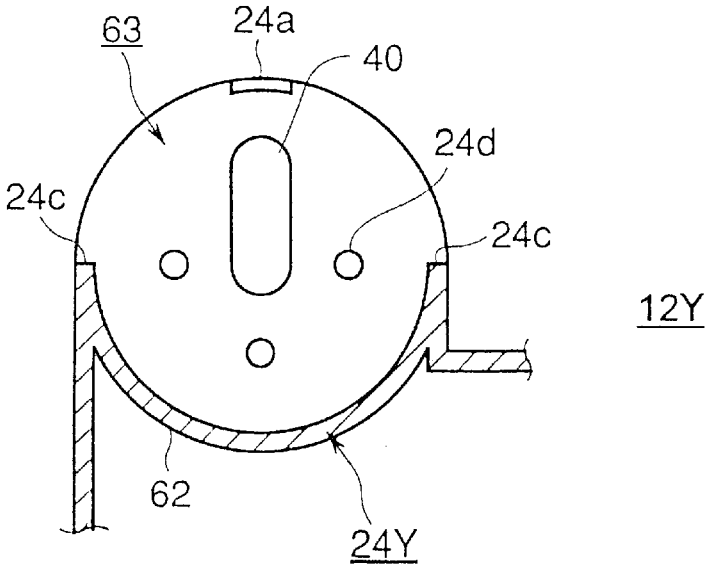
FIGS. 15, 16, 17, and 18 illustrate the image processing cartridges for yellow, magenta, cyan, and black, respectively.
Figure 16:
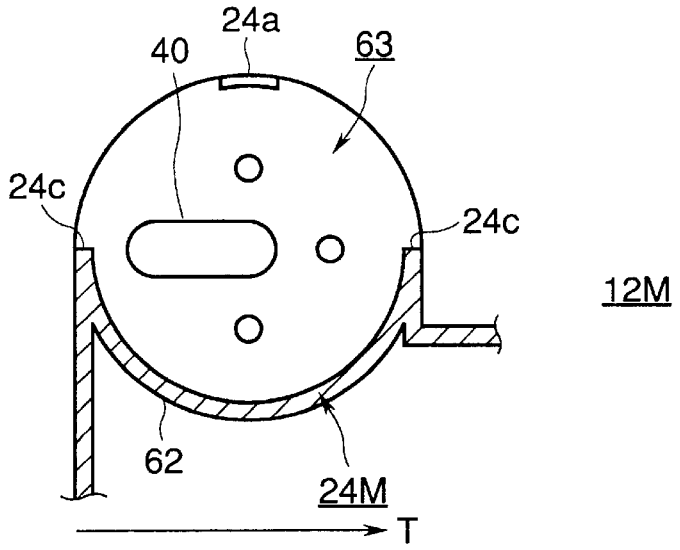
Figure 17:
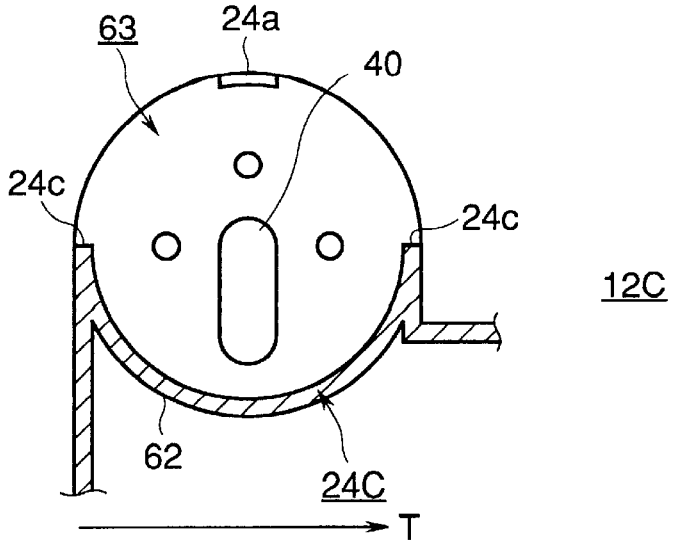
Figure 18:
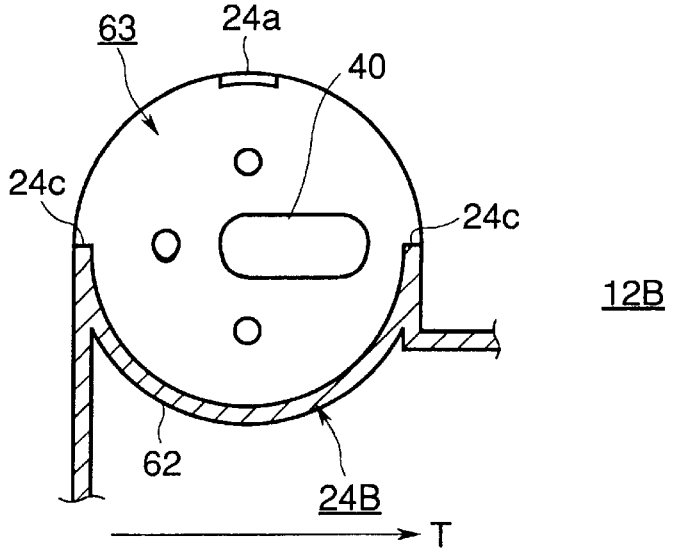

As shown in FIG. 15, the engagement piece 40 for the yellow image forming cartridge 12Y extends upwardly from the center of the circular surface of the engagement wall 63. As shown in FIG. 16, the engagement piece 40 for the magenta image forming cartridge 12M extends in the direction T of travel of the print medium, upstream of the center of the circular surface of the engagement wall 63. As shown in FIG. 17, the engagement piece 40 for the cyan image forming cartridge 12C extends downwardly from the center of the circular surface of the engagement wall 63. As shown in FIG. 18, the engagement piece 40 for the black image forming cartridge 12B extends in the direction T of travel of the print medium, downstream of the center of the circular surface of the engagement wall 63.

The operation for mounting the developer cartridge 22 to the receiving section is the same as that in the first embodiment and therefore detailed description thereof is omitted.

The image forming cartridges are initially mounted in the printer at the factory, and therefore, the engagement pieces 40 are assembled to the image forming cartridges by the assembly worker. The image forming cartridges may be also sold alone and mounted into the printer by the user, in which case the engagement piece 40 is mounted by the user to an appropriate position according to the user's desired color of toner.

The engagement wall 63 and developer cartridge 22 are formed with holes 24*d* and cutouts 31*b,* respectively, so that both engagement piece 40 and cap 31 can be arranged in different ways. However, either the engagement wall 63 or developer cartridge 22 may be formed with no holes or cutouts so that the developer cartridge or the image forming cartridge assembled for a specific color of toner cannot be reassembled for another color.

Third Embodiment

In the aforementioned second embodiment, the engagement wall 63 accepts only one projection 40. A third embodiment is directed to the engagement wall 63 which accepts more than one projections.

Figure 19:
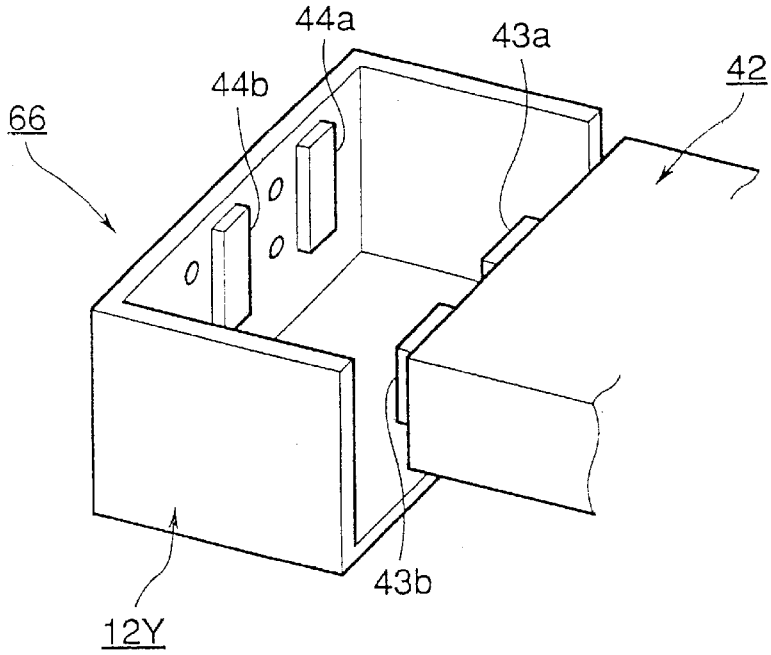
FIGS. 19, 20, and 21 are perspective views of the image processing cartridge, developer cartridge, and engagement piece of the third embodiment, respectively.
Figure 20:
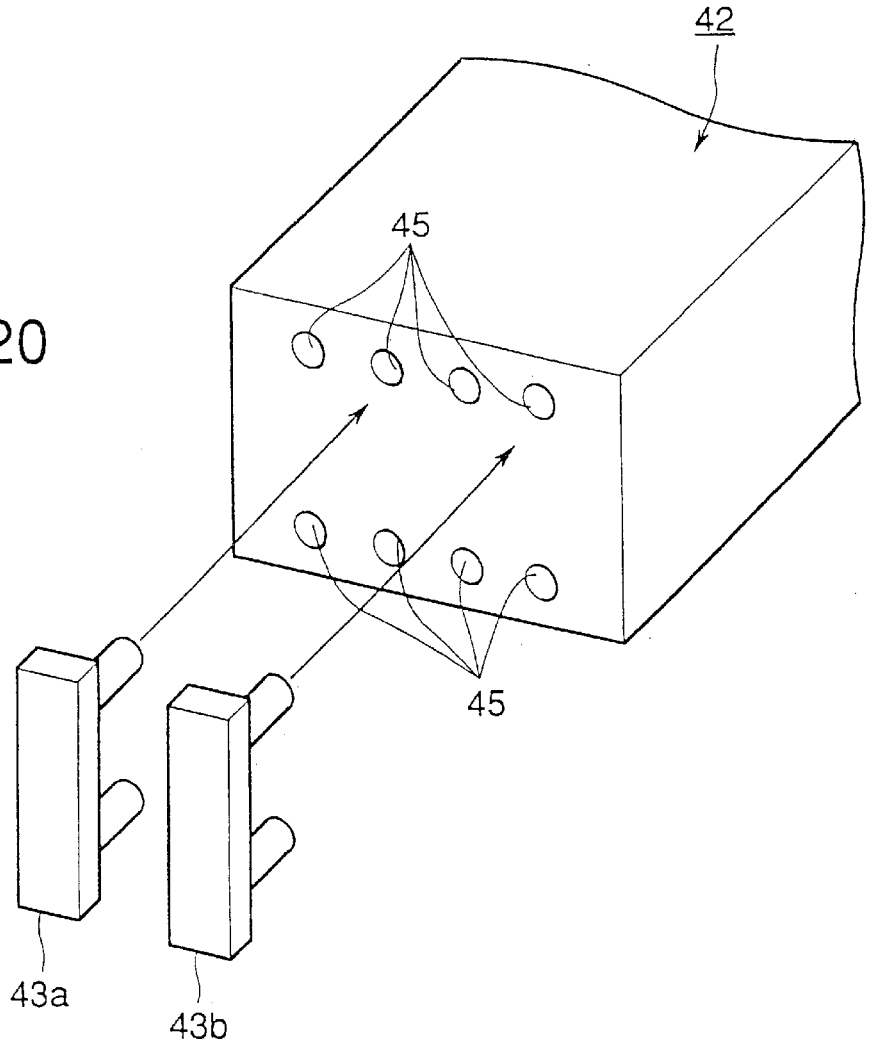
Figure 21:
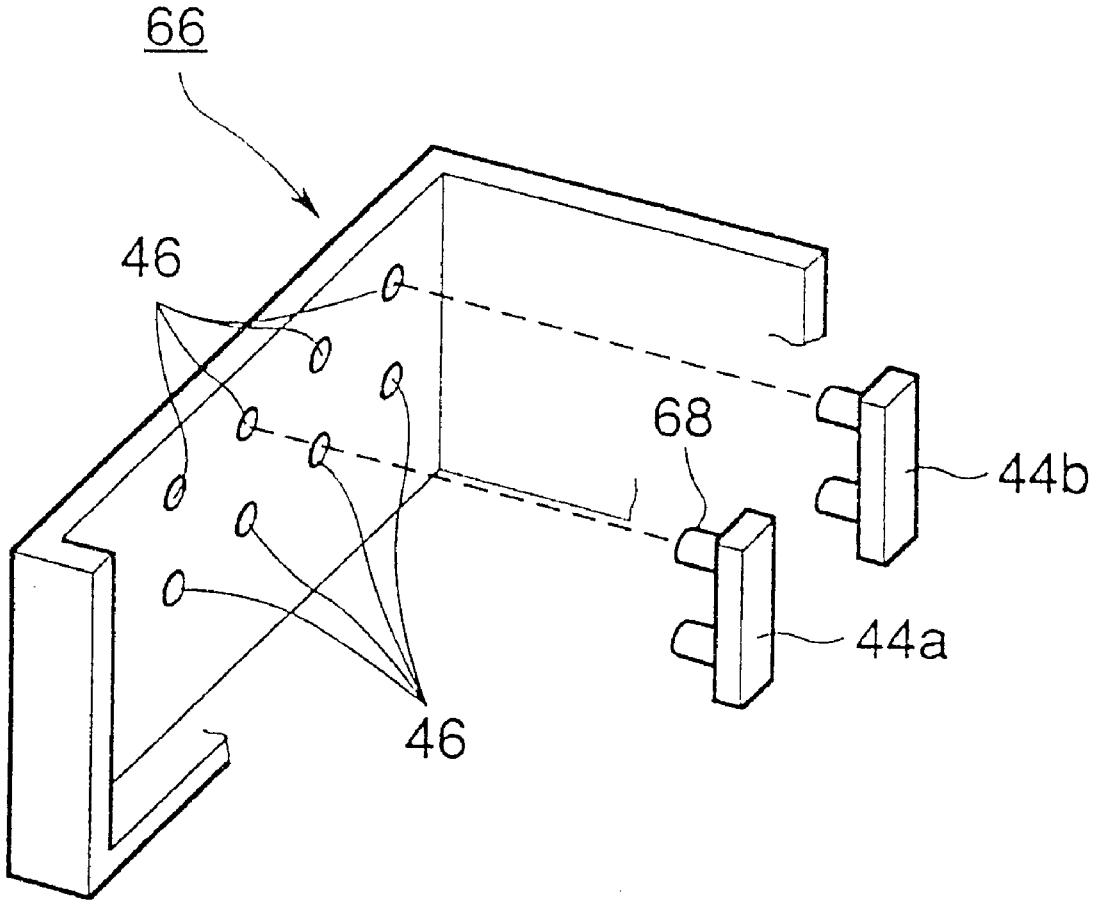

FIGS. 19, 20, and 21 are perspective views of the image forming cartridge, developer cartridge, and engagement piece of the third embodiment, respectively.

The image forming cartridges 12Y, 12M, 12C, and 12B are of the same construction and therefore only the yellow image forming cartridge 12Y will be described.

As shown in FIGS. 19–21, a developer cartridge 42 has engagement pieces 43*a* and 43*b* which are detachably mounted to one end surface of the developer cartridge 42. A cartridge-receiving section 66 of the image forming cartridge 12Y has engagement projections 44*a* and 44*b* which are detachably mounted to the engagement wall 66.

As shown in FIGS. 20 and 21, the developer cartridge 42 has a plurality of pairs of holes 45, holes in each pair being aligned vertically, and the engagement wall 66 has a plurality of pairs of holes 46, holes 46 in each pair being also aligned vertically. A total of eight holes 45 and a total of eight holes 46 are provided. Engagement pieces 43*a* and 43*b* each can be selectively fitted into any pair of holes 45 while engagement pieces 44*a* and 44*b* each can be selectively fitted into any pair of holes 46. The engagement pieces 43*a*–43*b* and 44*a*–44*b* are mounted during the manufacture of the printer.

The engagement pieces 43*a*–43*b* and engagement pieces 44*a*–44*b* are mounted so that they do not interfere with each other when the developer cartridge is attached into the cartridge-receiving section. A total of 6 different combinations of locations of the engagement pieces can be made so that the developer cartridges and cartridge-receiving sections can be polarized in six different ways. For the same reason as in the second embodiment, the engagement pieces 43*a*–43*b* and 44*a*–44*b* may be mounted at the factory or in the field by the user.

While the first to third embodiments have been described with respect to the electrophotographic printer 11, the construction may also be applicable to copying machines and printing apparatuses using developer cartridges, or to ink jet printers, copying machines, and other printing apparatuses using ink cartridges.

Although the engagement walls 63 and 66 are formed to oppose the longitudinal end surfaces of the developer cartridges 22 and 42, respectively, the engagement pieces may be formed at any other locations that oppose part of the developer cartridges.

The engagement wall 66 and developer cartridge 42 are formed with holes 46 and holes 45, respectively, so that both engagement pieces 44*a*–44*b* and 43*a*–43*b* can be arranged in different ways. However, either the engagement wall 66 or developer cartridge 42 may be formed with no holes therein so that the engagement pieces are provided at fixed locations and cannot detachably reassembled for different ways.

Fourth Embodiment

In the first to third embodiments, the image forming cartridges 12Y, 12M, 12C, and 12B are each mounted to a corresponding mounting location which is provided in the electrophotographic printer 11. There is possibility of image forming cartridges being misplaced when the user replaces a plurality of image forming cartridges at a time. Such a misplacement destroys the quality of a printed color image.

Figure 22:
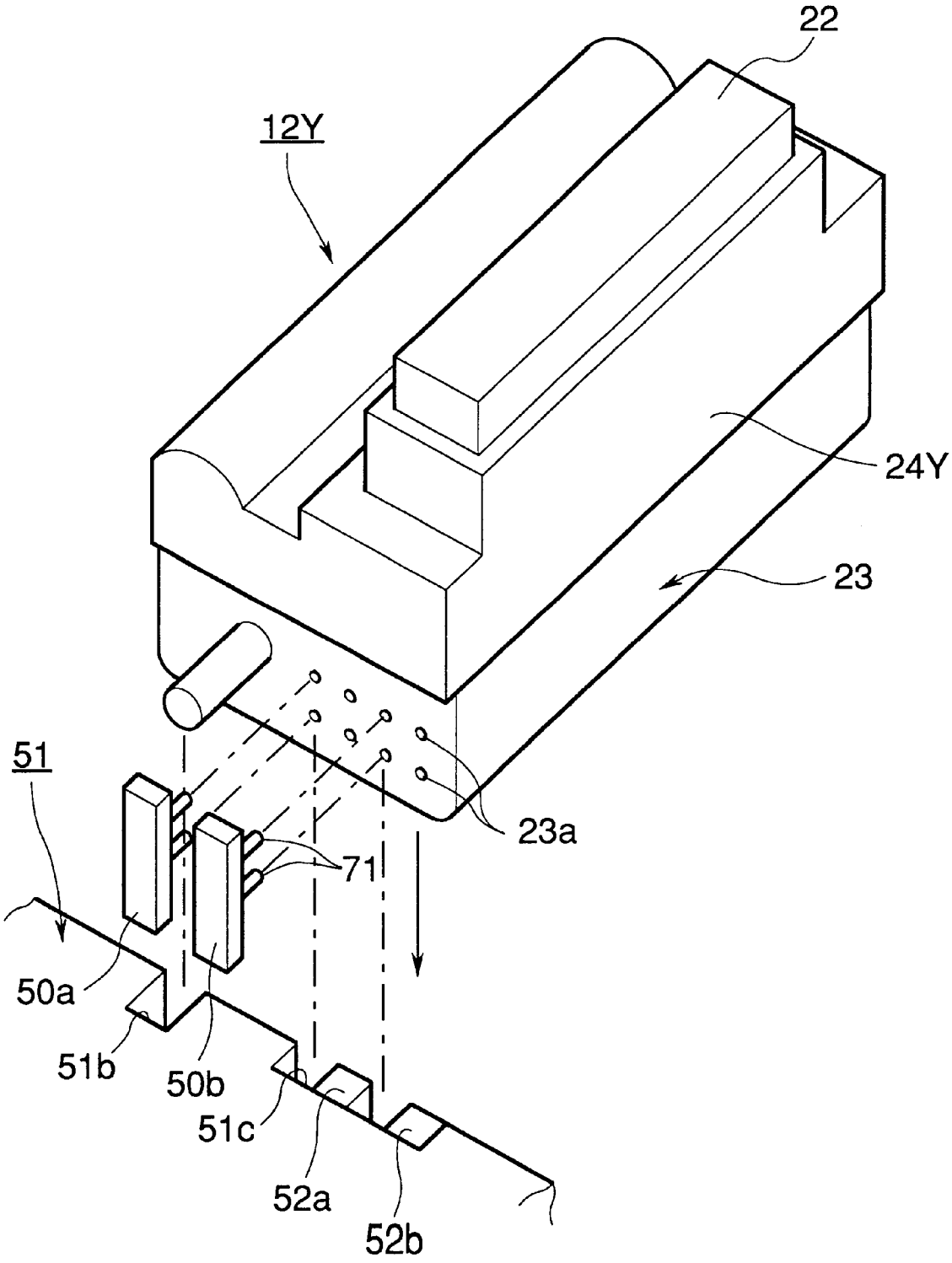
FIG. 22 is a perspective view, illustrating the image processing cartridge immediately before the image processing cartridge is mounted.
Figure 23:
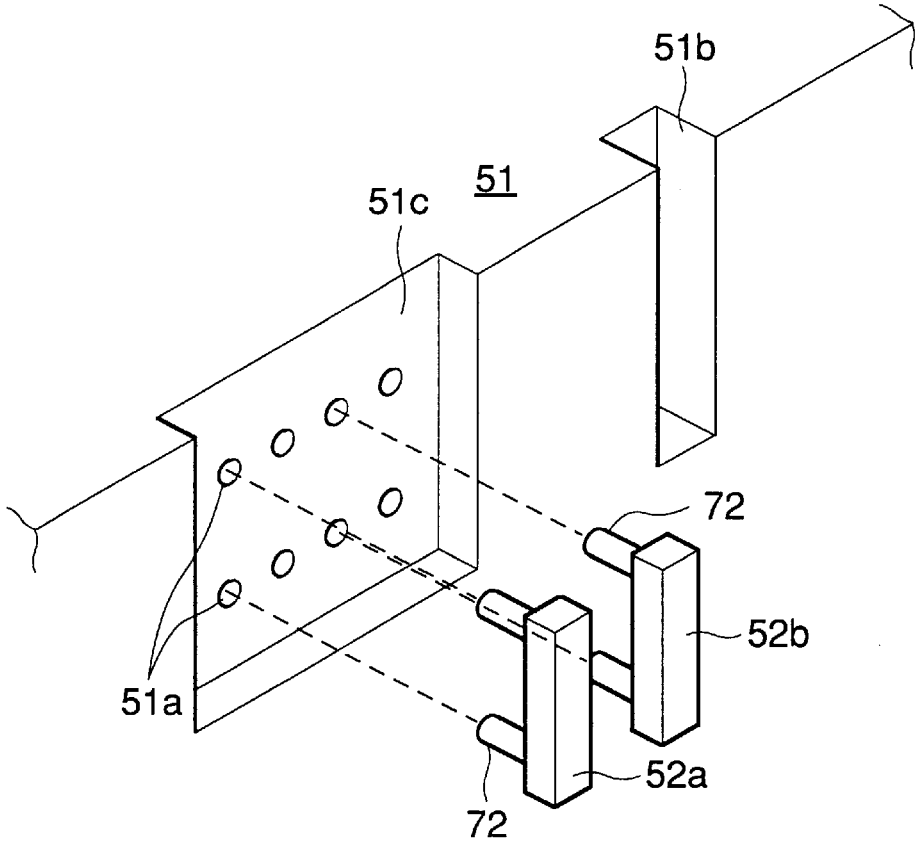
FIG. 23 is a perspective view, illustrating the body of an electrophotographic printer.
Figure 24:
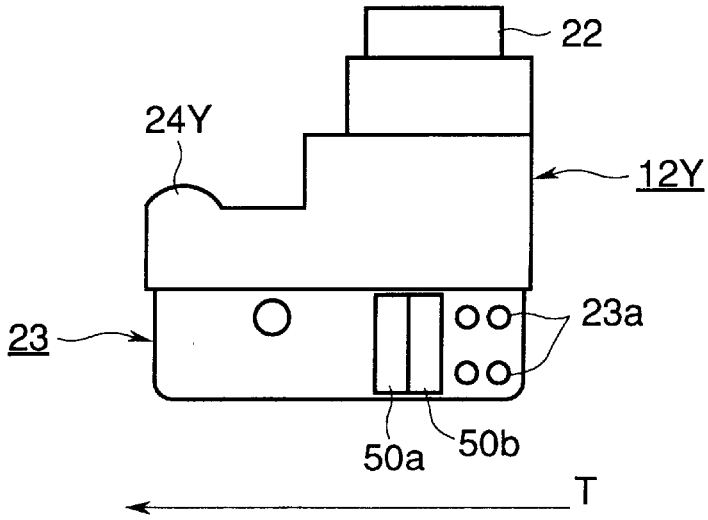
FIGS. 24–27 are side views of the image processing cartridges for yellow toner, magenta toner, cyan toner, and black toner, respectively.
Figure 25:
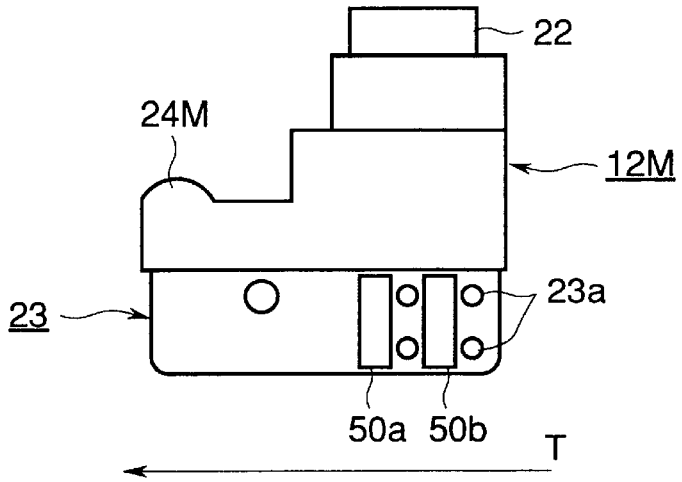
Figure 26:
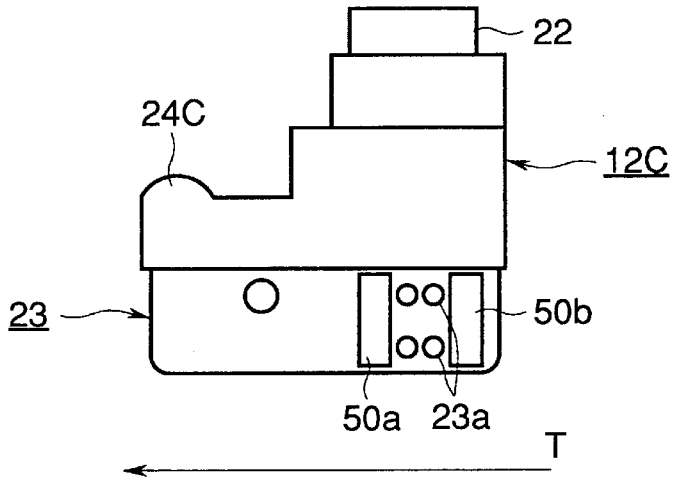
Figure 27:
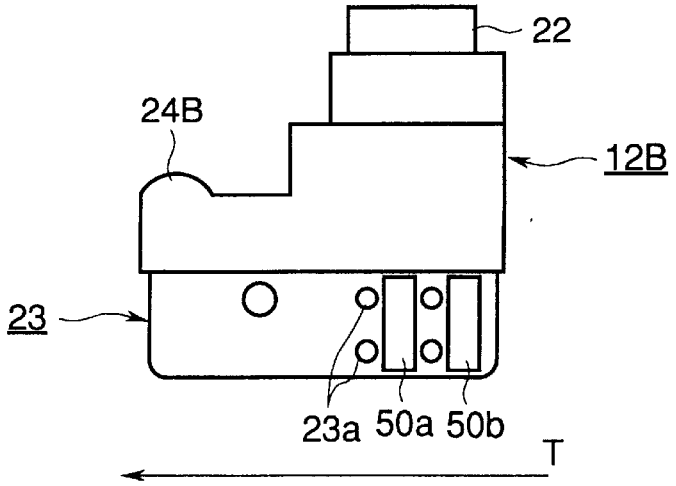
Figure 28:
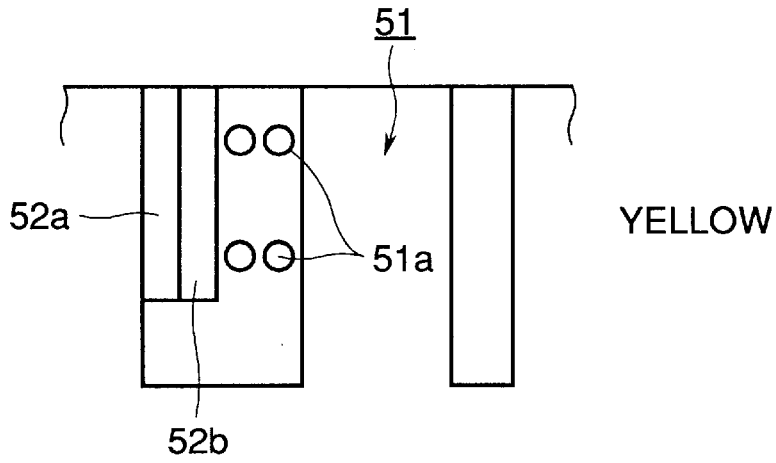
FIGS. 28–31 illustrate cartridge-receiving sections for image processing cartridges for yellow, magenta, cyan, and black, respectively.
Figure 29:
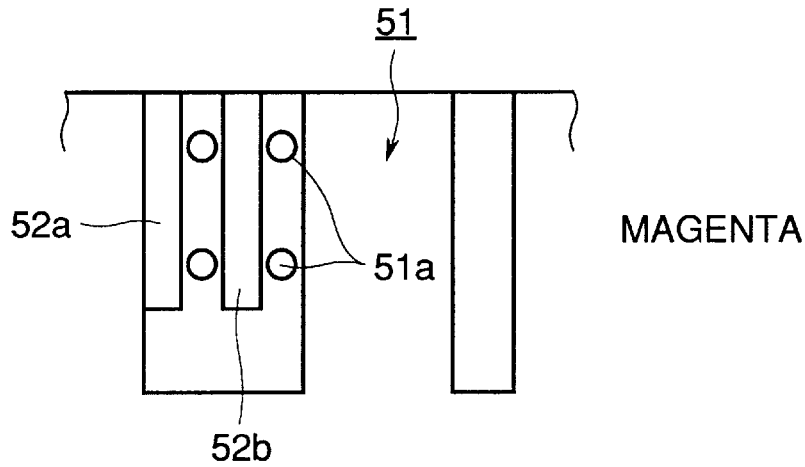
Figure 30:
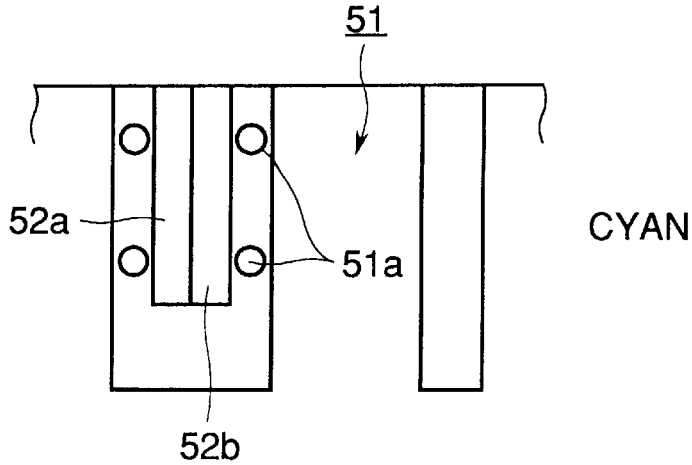
Figure 31:
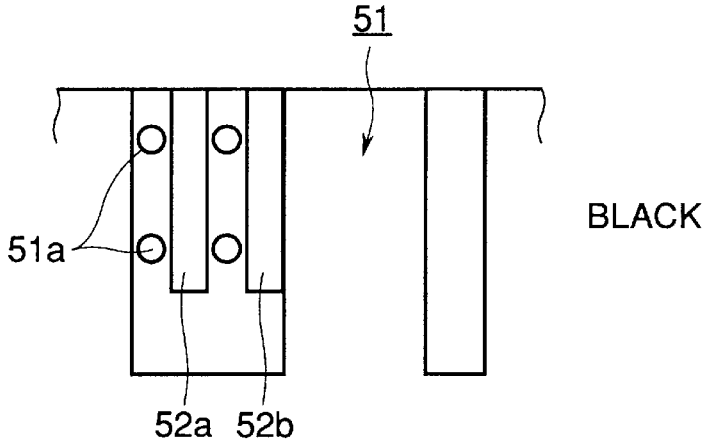

A fourth embodiment is directed to a construction where inadvertent misplacement of the image forming cartridges is prevented when the image forming cartridges are mounted to the printing stations. FIG. 22 is a perspective view, illustrating the image forming cartridge immediately before the image forming cartridge is mounted to the printing station. FIG. 23 is a perspective view, illustrating the body of an electrophotographic printer.

The image forming cartridges 12Y, 12M, 12C, and 12B are of the same construction and therefore only the image forming cartridge 12Y is described. The image forming cartridge 12Y includes an upper housing 24Y with a developer cartridge mounted thereon and a lower housing 23, and is assembled to the electrophotograhic printer from above. There are provided engagement pieces 50*a*–50*b* and engagement pieces 52*a*–52*b* for polarizing the image forming cartridges and corresponding cartridge-receiving sections, respectively, to prevent inadvertent misplacement of the image forming cartridges into the electrophotographic printer. The engagement pieces 50*a*–50*b* and engagement pieces 52*a*–52*b* are mounted such that they do not interfere with each other when the image forming cartridge is attached into the printer. A total of 6 different combinations of locations of the engagement pieces can be made so that the developer cartridges and cartridge-receiving sections can be polarized in six different ways.

Each of the engagement pieces 52*a* and 52*b* has parallel projections 72 and is detachably fitted into a pair of holes 51*a* formed in the cartridge-receiving section 51. The image forming cartridge 12Y has engagement pieces 50*a* and 50*b*. Each of the engagement pieces 50*a* and 50*b* has two parallel projections 71 and is detachably mounted into a pair of holes 23*a* formed in a side surface of a lower housing 23. The cartridge-receiving section 51 on the body of the printer is formed with a wide recess 51*c* and a narrow recess 51*b* therein. The wide recess 51*c* is formed with a plurality of pairs of holes 51*a,* each pair including vertically aligned two holes 51*a*.

The lower housing 23 is formed with a plurality of pairs of holes 23*a,* each pair including two vertically aligned holes and engagement pieces 71 are fitted into pairs of holes 23*a*. A total of eight holes 23 and a total of eight holes 51*a* are provided. Two engagement pieces 50*a* and 50*b* and two engagement pieces 52*a* and 52*b* are selectively fitted into any two pairs of holes 23*a* and holes 51*a,* respectively. Therefore, six different combinations are possible in polarizing the image forming cartridges according to toner color.

The engagement pieces 50*a*–50*b* and engagement pieces 52*a*–52*b* are mounted such that they do not interfere with each other when the image forming cartridge is mounted to the body of the printer.

FIGS. 24–27 are side views of the image forming cartridges for yellow, magenta, cyan, and black, respectively. FIGS. 28–31 illustrate cartridge-receiving sections for image forming cartridges for yellow, magenta, cyan, and black.

FIGS. 24–27 show engagement pieces 50*a* and 50*b* which have been mounted to the holes in the lower housing 23. A print medium travel in a direction shown by arrow T. FIGS. 24, 25, 26, and 27 show the positions of the engagement pieces 50*a* and 50*b* for yellow, magenta, cyan, and black, respectively, mounted to the lower housing 23.

FIGS. 28, 29, 30, and 31 show the positions of the engagement pieces 52*a* and 52*b* for yellow, magenta, cyan, and black, respectively. As is clear from FIGS. 24–31, the image forming cartridges for yellow, magenta, cyan, and black can be received into corresponding cartridge-receiving sections without inadvertent misplacement.

For example, if the user attempts to mount the image forming cartridge for yellow into the cartridge-receiving section for magenta, the engagement piece 50*b* interfere with the engagement piece 52*b,* preventing the user from misplacing the image forming cartridge for yellow. For the same reason as in the second embodiment, the engagement pieces may be mounted at the factory or in the field by the user.

For example, an electrophotographic printer 11 using a plurality of image forming cartridges requires that the respective image forming cartridges are spaced apart very accurately. Therefore, a main frame is usually made of a metal material and the side frame having the cartridge-receiving section 51 formed therein is molded from a resin. According to the fourth embodiment, the construction of the side frame can be the same for all the colors and therefore allows standardization of the side frame and improves production efficiency of the side frame.

The cartridge-receiving section 51 and image forming cartridge 12 are formed with holes 51*a* and holes 23*a,* respectively, so that both engagement pieces 52*a*–52*b* and 50*a*–50*b* can be arranged in different ways. However, the either cartridge-receiving section 51 or image forming cartridge 12 may be formed with no holes so that the engagement pieces are provided at fixed locations and cannot detachably be reassembled for different ways.

Fifth Embodiment

Figure 32:
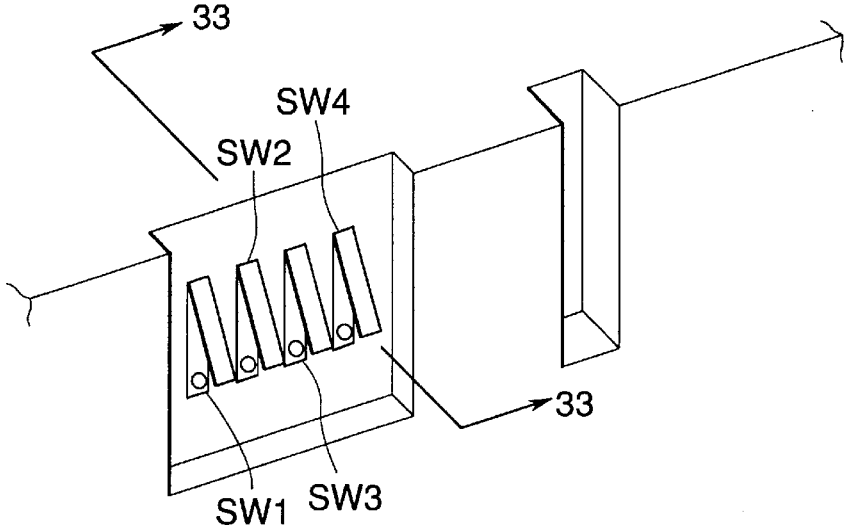
FIG. 32 is a perspective view of the engagement piece of the cartridge-receiving section according to a fifth embodiment.
Figure 33:
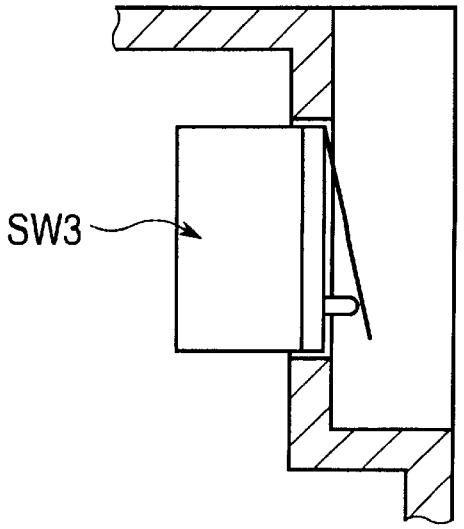
FIG. 33 is a cross-sectional side view taken along lines 33—33 of FIG. 32.
Figure 34:
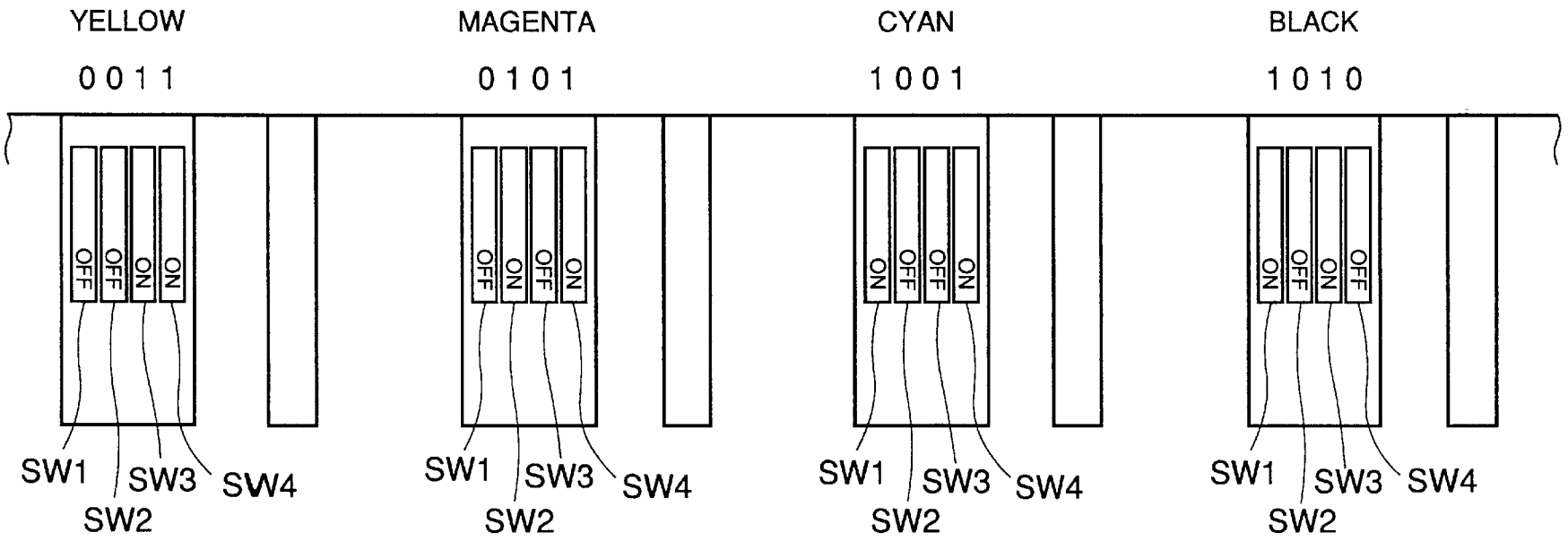
FIG. 34 illustrates the switches mounted to the cartridge-receiving sections for the respective colors.
Figure 35:
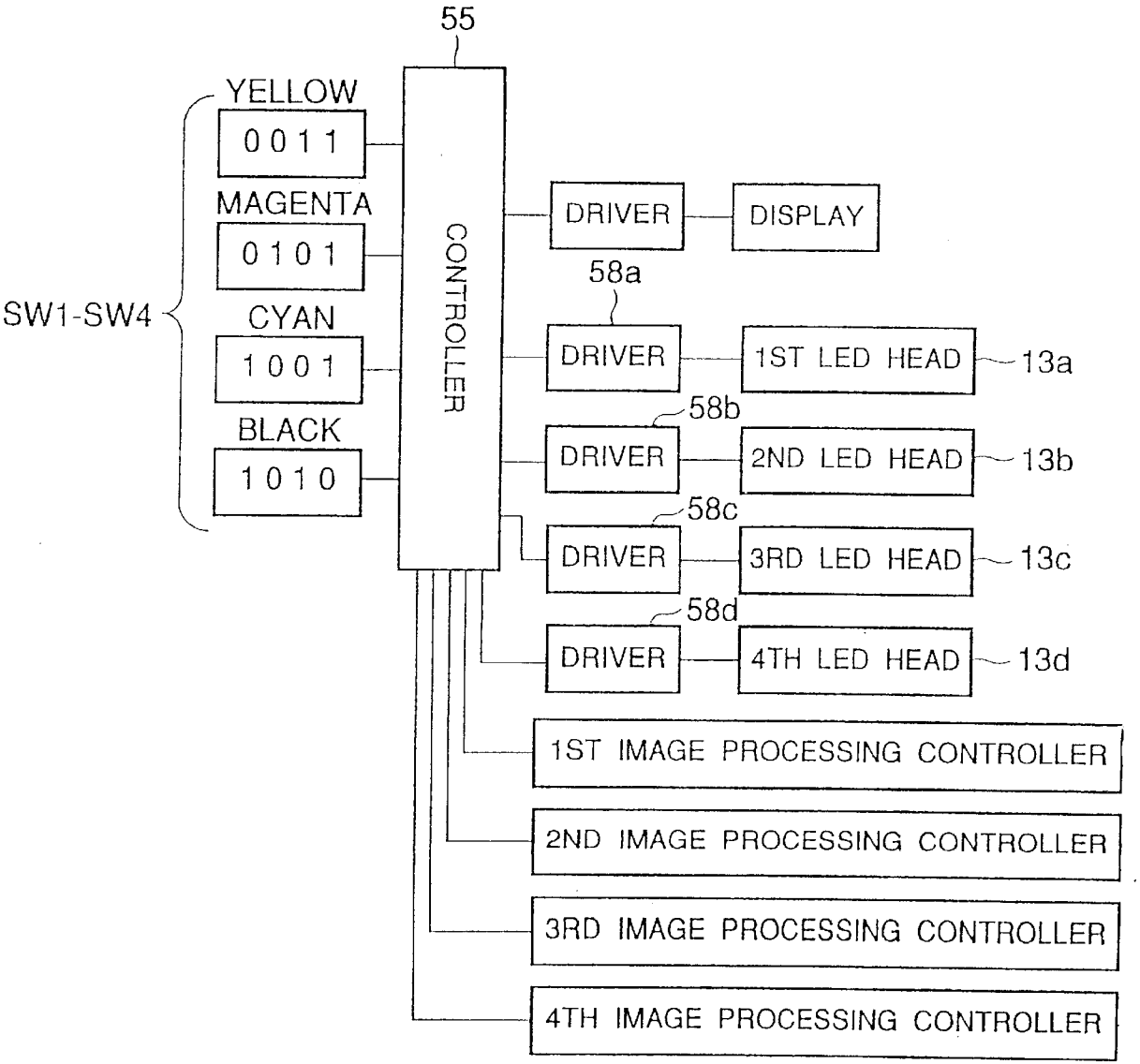
FIG. 35 is a block diagram showing the controller of the cartridge-receiving sections.

FIG. 32 is a perspective view of the cartridge-receiving section 51 according to a fifth embodiment. FIG. 33 is a cross-sectional side view taken along lines 33—33 FIG. 32. FIG. 34 illustrates the on-off states of the switches for the respective colors. FIG. 35 is a block diagram showing the controlling unit of the cartridge-receiving sections 51.

Just as in the fourth embodiment, each of the image forming cartridges 12Y, 12M, 12C, and 12B has the engagement pieces 50*a* and 50*b* detachably fitted into the holes 23*a*.

The cartridge-receiving section 51 is provided with micro switches SW1–SW4 in alignment with the pair of holes 23*a*. When the image forming cartridge is mounted in the cartridge-receiving section 51, the engagement pieces 50*a* and 50*b* push the lever of the micro switch opposing the engagement pieces. Thus, a set of four switches SW1–SW4 provides a four-bit binary signal which expresses a specific combination of locations of the engagement pieces 50*a* and 50*b*. This four-bit binary signal is sent to the controller 55 shown in FIG. 35 so that the controller 55 can indicate to the user what toner color of image-processing cartridge has been mounted in the cartridge-receiving section 51. The controller 55 may also indicate to the user when the image forming cartridge is misplaced. The controller 55 sends image data via a driver 58*a*, 58*b*, 58*c*, 58*d* to an LED head 13*a*, 13*b*, 13*c*, 13*d* only when the cartridge-receiving sections 51 has received the corresponding image forming cartridges.

Modification 1 of the Fifth Embodiment

Figure 36:
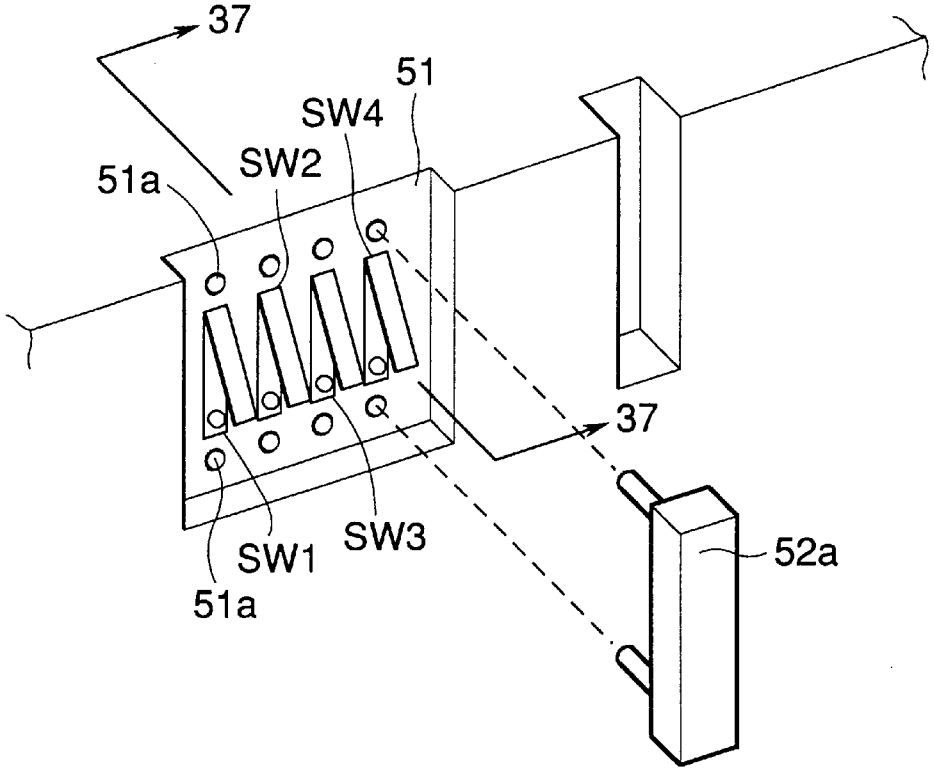
FIG. 36 is a perspective view of a modified cartridge-receiving section 51 according to a fifth embodiment.
Figure 37:
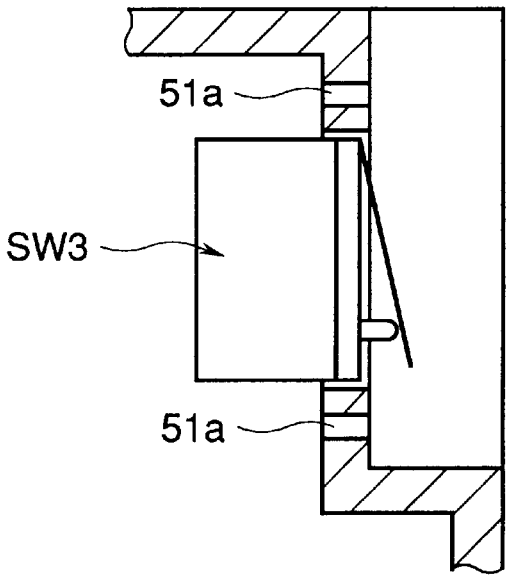
FIG. 37 is a cross-sectional side view taken along lines 37—37 FIG. 36.

FIG. 36 is a perspective view of a modified cartridge-receiving section 51 according to a fifth embodiment. FIG. 37 is a cross-sectional side view taken along lines 37—37 FIG. 36. The modified cartridge-receiving section 51 may have holes 51*a* into which engagement pieces 52*a* and 52*b* of the same construction as those in the fourth embodiment are fitted. When the engagement piece is fitted into the holes 51*a*, the engagement piece pushes the lever of a corresponding switch to switch on. Thus, the controller 55 can detect the location of the engagement pieces 52*a* and 52*b*, and indicates to the assembly personnel whether the engagement pieces 52*a* and 52*b* have been properly assembled.

While the fourth and fifth embodiments have been described with respect to the electrophotographic printer 11, the construction may also be applicable to copying machines and printing apparatuses using image forming cartridges, or to ink jet printers, copying machines, and other printing apparatuses using ink cartridges.

Although the cartridge-receiving section 51 is formed on the side frame to oppose the longitudinal end surface of the image forming cartridge, the cartridge-receiving section 51 may be formed at any other location where the cartridge-receiving section opposes part of the developer cartridge.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Modification 2 of the Fifth Embodiment

Modification 2 differs from the fifth embodiment in the operation of the controller 55. The controller 55 receives the signals from switches SW1–SW4 and can therefore identify receiving sections into which the respective image forming cartridges of yellow, magenta, cyan, and black are mounted. In other words, the image forming cartridges of yellow, magenta, cyan, and black can be correctly identified by the controller 55 regardless of which receiving section each cartridge is placed into. Since the receiving sections are identified in terms of color, the controller 55 can determine print data which should be supplied to each of the drivers 58*a*–58*d* for first to fourth LED heads 13*a*–13*d*. This modification relieves the users of the problem where the respective image forming cartridges must be placed into corresponding receiving sections.

What is claimed is:

1. An image forming apparatus having a plurality of image forming stations, comprising:

devices having corresponding first engagement portions; and receiving sections provided at the corresponding image forming stations and having corresponding second engagement portions, said receiving sections detachably receiving corresponding ones of said devices therein with the second engagement portions fittingly engaging the first engagement portions;

wherein at least ones of the first engagement portions and at least ones of the second engagement portions are constructed of a member of a same shape, at least one of the first and second members being detachably assembled into different configurations such that the first engagement portions engage the second engagement portions in different engagement relations when said devices are received in said receiving sections, each of said devices being received in a corresponding one of said receiving sections.

2. The image forming apparatus according to claim 1, wherein said devices are image forming cartridges attached to the image forming stations and said receiving sections are formed in a body of the image forming apparatus.

3. The image forming apparatus according to claim 1, wherein said devices are developer cartridges and said receiving sections are formed in image forming cartridges attached to the image forming stations.

4. The image forming apparatus according to claim 3, wherein each of said developer cartridges includes a first part and a second part, the second part having one of the first engagement portions, each of the first engagement portions being constructed of a member of a same shape, the second part being assembled to the first part such that the one of the first engagement portions is oriented relative to the first part in one of a plurality of ways.

5. The image forming apparatus according to claim 4, wherein said second engagement portions include a set of engagement pieces and a set of engagement holes to which the engagement pieces are mounted such that the engagement pieces are oriented relative to the image forming cartridges in different ways.

6. An image forming apparatus having a plurality of image forming stations, comprising:

devices having corresponding first engagement portions, the first engagement portions being detachably mounted to said devices at different locations; and receiving sections provided at the corresponding image forming stations and detachably receiving corresponding ones of said devices, said receiving sections having corresponding switches operated by the first engagement portions when said receiving sections receive said devices therein;

wherein the first engagement portions and the switches can be assembled into different constructions so that the switches are operated by the first engagement portions only when the receiving sections receives corresponding devices.

7. A developer cartridge for use in an image forming apparatus, the developer cartridge comprising:

an engagement portion; and a mounting section having at least two mounting locations such that said engagement portion is selectively detachably mountable to the at least two mounting locations; wherein when said engagement portion is mounted to one of the at least two mounting locations, the developer cartridge is in a corresponding one of different configurations so that the developer cartridge is properly attached to the image forming apparatus when said engagement portion engages a corresponding receiving section of the image forming apparatus.

8. A developer cartridge for use in an image forming apparatus, the developer cartridge comprising:

a first part; and a second part having an engagement portion and a plurality of mating sections, said second part being detachably mountable to said first part selectively through the plurality of mating sections; wherein, when said second part is mounted to said first part through one of a plurality of mating sections, the engagement portion has a corresponding one of different orientations relative to said first part, so that the developer cartridge is properly attached to the image forming apparatus when said engagement portion engages a corresponding receiving section of the image forming apparatus.

9. An image forming apparatus having a plurality of image forming stations, comprising:

devices having corresponding first engagement portion; and receiving sections provided at the corresponding image forming stations and having corresponding second engagement portions, said receiving sections detachably receiving corresponding ones of said devices therein with the second engagement portions fittingly engaging the first engagement portions;

wherein each of the second engagement portions are detachably mounted to said receiving sections and at least ones of the first engagement portions and the second engagement portions can be assembled into different constructions so that the first engagement portions engage the second engagement portions in different engagement relations when said devices are received in said receiving sections, each of said devices being received in a corresponding one of said receiving sections.

10. The image forming apparatus according to claim 9, wherein said second engagement portions include a set of engagement pieces and a set of engagement holes to which the engagement pieces are mounted such that the engagement pieces are oriented relative to the image forming cartridges in different ways.

* * * * *